United States Patent [19]

Ecklor, Jr.

[11] 4,157,179

[45] Jun. 5, 1979

[54] ARM EXERCISING DEVICE

[76] Inventor: Edward Ecklor, Jr., 211 S. Sixth Ave., Marshalltown, Iowa 50158

[21] Appl. No.: 823,531

[22] Filed: Aug. 10, 1977

[51] Int. Cl.[2] ..... A63B 23/00

[52] U.S. Cl. ..... 272/67; 272/136; 272/DIG. 4

[58] Field of Search ..... 272/67, 68, 78, 136, 272/142, 143, DIG. 4; 273/1, 74; 211/79; 248/23; 63/3; 24/81 AA, 81 A, 73 LA, 263 R, 353

[56] References Cited

U.S. PATENT DOCUMENTS

| | | | |
|---|---|---|---|
| 827,260 | 7/1906 | Nickles | 24/73 LA |
| 1,556,579 | 10/1925 | Baltzley | 24/263 R |
| 1,631,355 | 6/1927 | Baldwin | 24/73 LA |
| 2,227,365 | 12/1940 | Prevost | 24/263 R |
| 2,782,033 | 2/1957 | Ugartechea | 272/67 |

FOREIGN PATENT DOCUMENTS

| | | | |
|---|---|---|---|
| 229144 | 2/1925 | United Kingdom | 272/78 |

*Primary Examiner*—Richard C. Pinkham
*Assistant Examiner*—William R. Browne
*Attorney, Agent, or Firm*—Howard I. Podell

[57] ABSTRACT

A self-operating device for practicing arm wrestling having an adjustable base; an adjustable upstanding lever fulcrumed on the base with a handle pivoted at a right angle to the lever and a tension spring stretching from one side of the base to a point in the upper part of the lever. One hand holds the base while the other hand applies force to the handle against the tension spring.

3 Claims, 2 Drawing Figures

ARM EXERCISING DEVICE

FIELD OF THE INVENTION

This invention relates to an apparatus for practicing arm wrestling which can be used with either hand and can be adjusted to accomodate forearms of different lengths. The apparatus is useful as an exerciser, a game, and for physical therapy.

THE PRIOR ART

Devices of this type are becoming extremely popular and are receiving widespread attention and acceptance.

The prior art, as exemplified by U.S. Pat. Nos. 3,938,389; 2,689,127; 2,782,033 and 2,938,695 is generally illustrative of various devices of this type. While such devices are generally acceptable for their intended purpose, they have not proven to be entirely satisfactory in that they are either complex and expensive to manufacture, or bulky and inconvenient to use, or require unusual skill and/or dexterity to operate. As a result of the shortcomings of the prior art, typified by the above, there has developed and continues to exist a substantial need for devices of the character described. Despite this need, and the efforts of many individuals and companies to develop such devices, a satisfactory device meeting this need has heretofore been unavailable.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
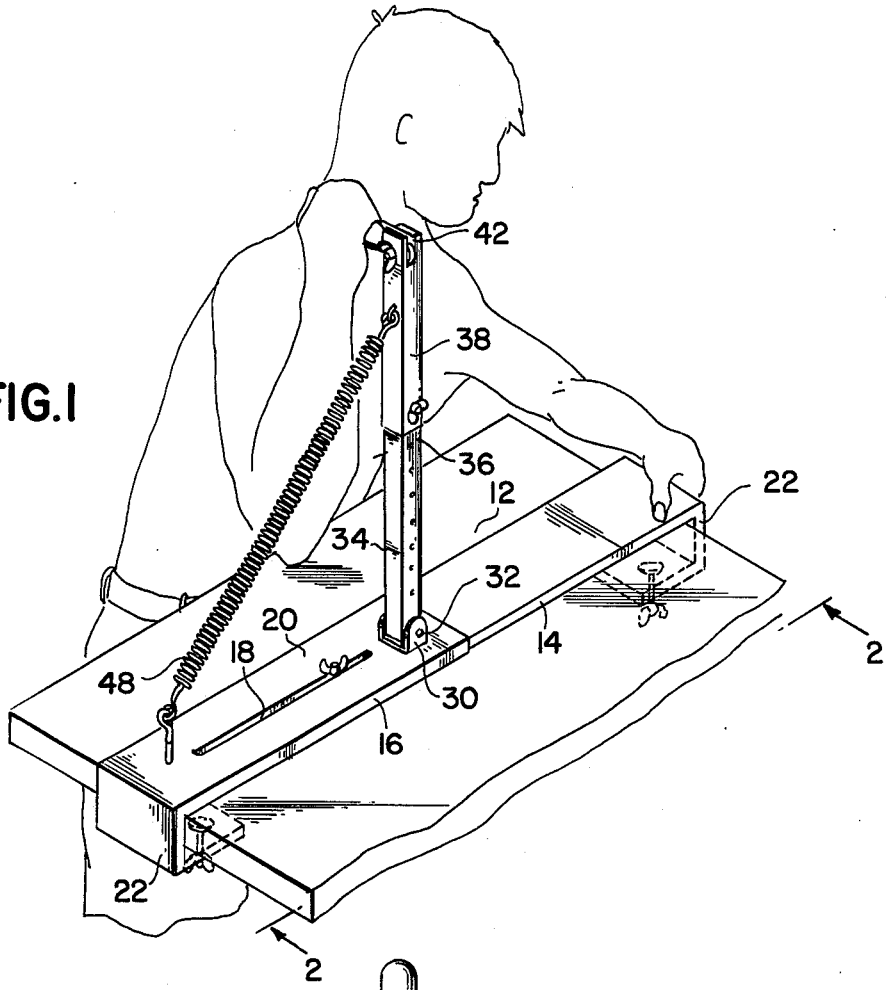
FIG. 1 is a view in perspective showing the apparatus of the invention in use.

Referring to the drawing in greater detail, the invention is seen to conist of an elongated flat base 12 consisting of two slidable elements 14 and 16. The latter has edges formed into a slide and has a slot 18 therein to allow passage of a rod threaded in element 14 to adjust the length of base 12 by tightening wing nut 20 on the rod. The outer ends of members 14 and 16 are formed into a clamp 22 which is tapped with screw threads to receive a vertical clamping screw 24 having rigidly attached at its lower end a handle 26 and a rockable flat table-engaging pad 28 at the upper end thereof. This arrangement enables to adjustably mount the apparatus on a table as shown.

Pivot 30 is mounted on the upper surface of member 16. Secured thereto by pin 32 is a height-adjustable upstanding lever consisting of a lower member 34 having a plurality of openings 36. An upper sleeve-like member 38 fits over member 32 and is adjustably secured thereon by set screw 40 which passes through an opening therein and through the opening 36 selected in the lower member 32. This arrangement allows adjustment to accomodate forearms of different lengths.

Figure 2:
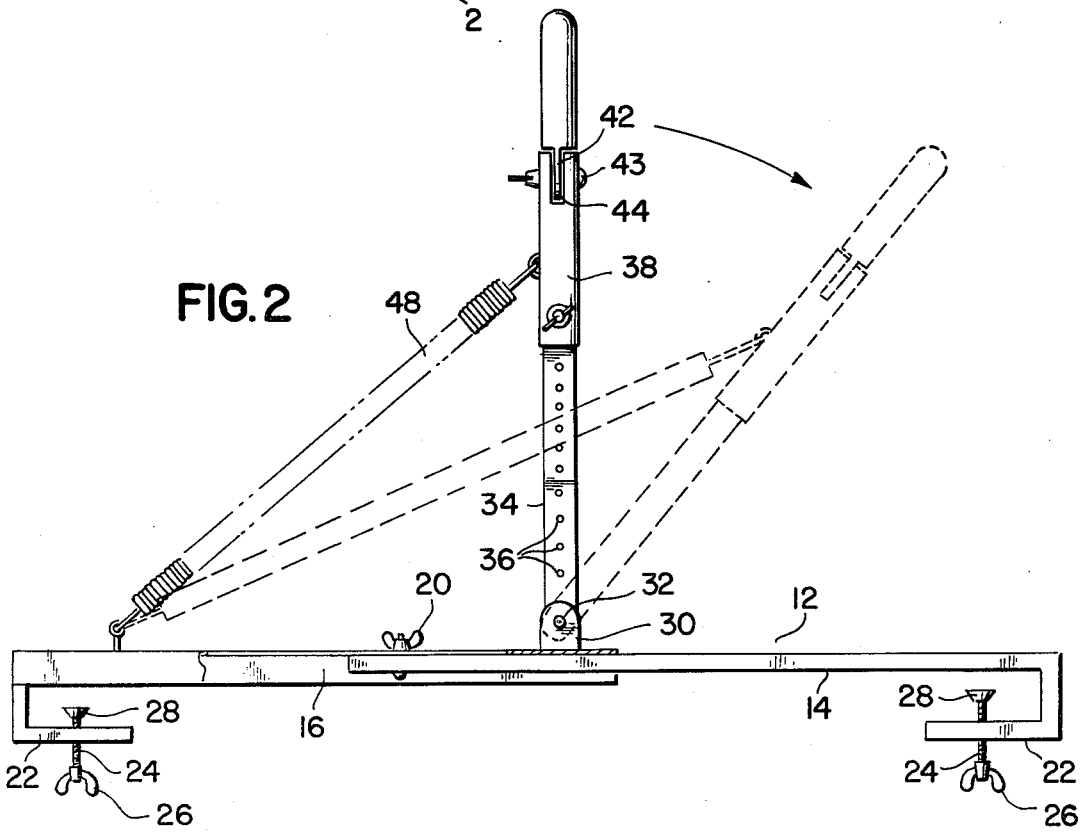
FIG. 2 is a cross-sectional view taken on line 2—2 of FIG. 1 with the parts shown in operative relation.

As shown in FIG. 2 the upper part of member 38 has a wide slot 42 in which is pivoted by pin 43 the thin end 44 of handle 46. A wing nut 48 serves to fix the handle at right angle to member 38 on either side thereof so that the apparatus can be used with the right hand or the left hand.

Various tensioning means can be stretched between the pull lever and base 12 including weights, a vacuum cylinder or springs. In the embodiment shown a coil spring 48 is detachably stretched between member 38 and base 12 by hooks and staples.

Exercise is obtained by bringing the lever to the position shown in dotted lines in FIG. 2.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. An exercising device comprising a supporting base consisting of two elongated, slidably adjustable telescoping parts, each part having an outer end formed in a table-engaging clamp; an upstanding lever pivoted directly to a first part of the parts of said base; a handle mounted to said lever; and tensioning means stretched between said lever and said first part of the said base to resist a force applied by a user to pivoting of the lever.

2. The invention as recited in claim 1 in which the handle is pivotally mounted to said lever.

3. The invention as recited in claim 2 in which the handle is free to pivot about either side of the axis of the lever so that the device may be alternatively grasped in the use position, from either of two opposing sides of a table to which it is mounted, by either a right or a left hand of the user, respectively.

* * * * *